United States Patent [19]

Lee et al.

[11] Patent Number: 4,502,942

[45] Date of Patent: Mar. 5, 1985

[54] ENHANCED OIL RECOVERY FROM WESTERN UNITED STATES TYPE OIL SHALE USING CARBON DIOXIDE RETORTING TECHNIQUE

[75] Inventors: Sunggyu Lee, Copley, Ohio; Rajendra Joshi, Arlington, Tex.

[73] Assignee: The University of Akron, Akron, Ohio

[21] Appl. No.: 578,360

[22] Filed: Feb. 8, 1984

Related U.S. Application Data

[63] Continuation-in-part of Ser. No. 488,441, Apr. 25, 1983, abandoned.

[51] Int. Cl.[3] ..... C10G 1/00

[52] U.S. Cl. ..... 208/11 R

[58] Field of Search ..... 208/11 R

[56] References Cited

U.S. PATENT DOCUMENTS

| | | | |
|---|---|---|---|
| 3,058,904 | 10/1962 | Deering et al. | 208/11 R |
| 3,074,877 | 1/1963 | Friedman | 208/11 R |
| 4,162,959 | 7/1979 | Duraiswamy | 208/8 R |
| 4,243,511 | 1/1981 | Allred | 208/11 R |
| 4,344,839 | 8/1982 | Pachkowski et al. | 208/11 R |

*Primary Examiner*—Delbert E. Gantz
*Assistant Examiner*—Anthony McFarlane
*Attorney, Agent, or Firm*—Oldham, Oldham & Weber Co.

[57] ABSTRACT

A retort process and product therefrom relating to the recovering of oil from Western-type U.S. shale utilizing carbon dioxide as a sweep gas. Other contributing factors with regard to increase in recovery include the heating rate, the sweep gas rate, particle size, and final temperature. The amount of increased recovery over conventional systems ranges up to about 25 percent.

9 Claims, 1 Drawing Figure

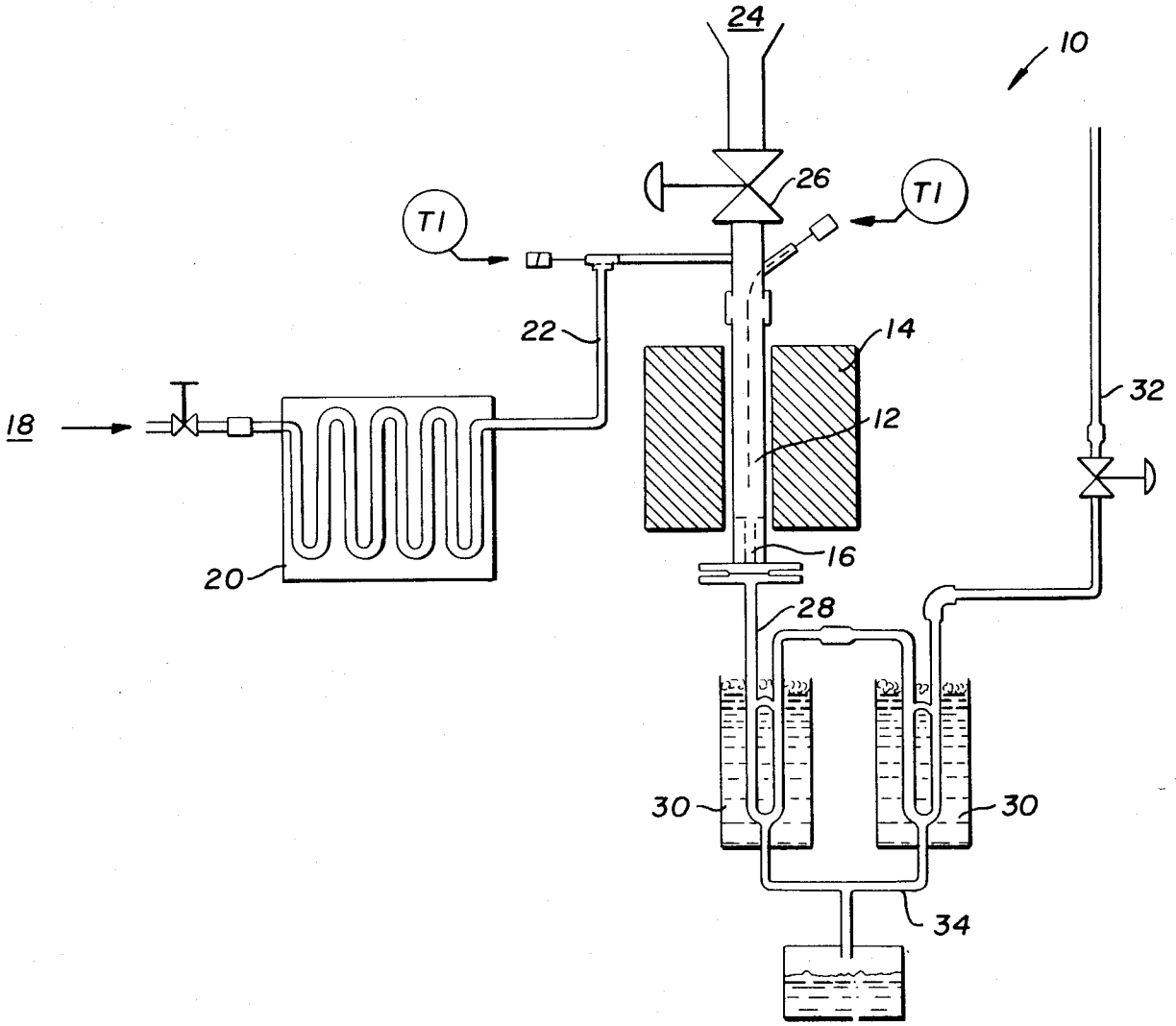
10
32
30
34
T1
14
12
16
28
26
24
30
22
T1
20
18

ENHANCED OIL RECOVERY FROM WESTERN UNITED STATES TYPE OIL SHALE USING CARBON DIOXIDE RETORTING TECHNIQUE

This application is a continuation in part of my copending U.S. application bearing U.S. Ser. No. 488,441, filed Apr. 25, 1983 now abandoned for "ENHANCED OIL RECOVERY FROM WESTERN UNITED STATES TYPE OIL SHALE USING CARBON DIOXIDE RETORTING TECHNIQUE".

TECHNICAL FIELD

The present invention relates to the use of carbon dioxide as a sweep gas in the retorting of oil shale to substantially enhance the oil yield.

BACKGROUND ART

Various processes for extracting hydrocarbons from oil shale have long been known. They generally involve retorting the shale, that is, heating it to a high enough temperature so that the hydrocarbon material contained in the rock is pyrolyzed or broken down. Once this is accomplished, the hydrocarbons generally separate from the rock substrate and are recovered in gaseous and liquid form. One commonly used method for recovery of the gaseous fraction is by sweep or carrier gas, wherein a relatively inert, noncondensable gas is passed through the retorting shale, carrying with it the gaseous hydrocarbons. Thereafter the hydrocarbons are condensed and removed from the carrier system. The most commonly used inert gas has been nitrogen due to its availability and low cost. Steam has also been used to an extent, however, it does produce some side reaction.

The present invention utilizes carbon dioxide as the carrier gas. Heretofore, carbon dioxide has not been used, presumably because of its higher cost relative to nitrogen. The use of carbon dioxide has however unexpectedly been found to be beneficial from the standpoint of oil yield, which can be substantially increased under controlled conditions in a carbon dioxide system.

DISCLOSURE OF THE INVENTION

It is accordingly an aspect of the invention to provide a process for retorting oil shale, and particularly Western U.S. oil shale, wherein the recovery of oil is enhanced by utilizing carbon dioxide as a sweep gas.

It is another aspect of the invention to provide a process, as above, wherein the shale is heated at a specific rate until the desired retorting temperature is reached.

It is yet another aspect of the invention to provide a process, as above, wherein the oil shale is crushed to a specified particle size.

It is still another aspect of the invention to provide a process, as above, wherein the carbon dioxide gas is swept through the oil shale at a specified flow rate.

It is yet another aspect of the invention to provide a process, as above, wherein the process can be carried out utilizing conventional, existing retorting equipment.

It is still another aspect of the invention to provide a process, as above, which can be used in situ or ex situ.

It is yet another aspect of the invention to provide a process, as above, which can utilize carbon dioxide from geologic sources.

These and other aspects of the present invention will become more apparent as the specification proceeds, which are achieved by: a process for pyrolysis of oil shale comprising: crushing a quantity of oil shale to a particle size from about −40+20 mesh to 10 cm. in diameter; heating said shale at a rate from about 2° C./min to 20° C./min until a final temperature of between 400° C. to 700° C. is achieved, maintaining said shale at said final temperature and causing a pyrolysis reaction in said shale thereby at a pressure of from about 0.5 to about 1.5 atmospheres; releasing gaseous and liquid product from said shale by means of said pyrolysis reaction; conveying said product from said shale by means of a stream of carbon dioxide gas passed through said shale at a rate from about 0.5 cc/sec/100 cc of reactive volume at standard temperature and pressure to about 10 cc/sec/100 cc of reactor volume at standard temperature and pressure, and at a temperature from about 400° C. to 700° C.; and cooling said product and thereby liquefying the condensable portions thereof.

BRIEF DESCRIPTION OF THE DRAWINGS

For a better understanding of the invention, reference is made to the attached drawing wherein; the figure is a schematic diagram of an oil shale apparatus and process according to the present invention.

BEST MODE FOR CARRYING OUT THE INVENTION

The present invention is concerned primarily with the improvements obtainable in the retorting of Western U.S. type oil shale using carbon dioxide as the carrier or sweep gas. The emphasis on Western shale is due not to a prejudice against other shales, but merely results from a desire to benefit the processing of the most widely used type of oil shale, viz., the various Iocene shales. It will thus be appreciated that the disclosure given herein can also be applied to the processing of other shales such as those found in the Eastern United States.

Two general types of processes are currently used for recovery of kerogen from shale, namely ex situ and in situ. In ex situ, the shale is mined and then processed in equipment above ground, while the opposite is true of in situ, wherein processing is carried out underground and on site. Either process however can utilize the same method of pyrolysis reaction to extract the kerogen from the rock substrate.

The shale must first be crushed or ground to a suitable particle size so that the heat and mass (pyrolysis product) transfer can occur without strong resistances. If an in situ process is used, particle size reduction may be effected by strategically placed underground explosive charges, or the like. The shale is then heated to a temperature sufficient to cause reaction and subsequent release of the kerogen. At pyrolysis temperatures, the kerogen decomposes to form gaseous and liquid products which must be transferred from the reaction site by a sweep or carrier gas passing through the bed of shale in a continuous fashion by diffusional mechanisms. The gaseous product is then condensed by suitable means.

It has unexpectedly been discovered that by the use of carbon dioxide as a sweep gas, the yield of oil may be substantially increased over the prior art. It has further been discovered that the total recovery of shale oil is increased under specialized process conditions.

A schematic diagram of an ex situ process can be seen in the FIGURE and the retorter is designated generally by the number 10.

Oil shale, having a predetermined particle size distribution, is positioned within a pyrolysis chamber 12 by means of a loading port 24 and a loading valve 26. Heating means such as a furnace 14 surrounds the pyrolysis chamber and has appropriate controls to enable the rate of heating of the chamber to be varied. Naturally, since pyrolysis is involved, the reaction is carried out at ambient pressure, that is from about 0.5 to about 1.5 atmospheres, desirably from about 0.8 to about 1.2 atmospheres, and preferably at about 1 atmosphere. A sweep gas source 18 is conveyed to the pyrolysis chamber 12 through a conduit 22 after having first passed through a preheating chamber 20.

Kerogen is decomposed in the oil shale at a temperature of about 400°-700° C. The reaction temperature is thus from about 400° C. to about 700° C., desirably between about 450°-650° C. with from about 475°-600° or 610° C. being preferred. Gaseous and liquid product exits the pyrolysis chamber through an oil collection tube 16 having a plurality of apertures (not shown). A conduit 28, connected to the collection tube 16, conveys the kerogen to one or more condensers which convert the kerogen to liquid form. The liquid is then removed from the condensers by appropriate means, such as for example a collection apparatus 34 communicating with the lower portion of the condensers 30. The noncondensable sweep gas may be recycled to the pyrolysis chamber by means of return loop 32.

The carrier gas used in the invention, carbon dioxide, has been found to increase the oil yield by at least seven percent when compared to the identical process utilizing the most often used gas of the prior art, nitrogen. In some instances, oil yield has been increased by as much as 25 percent. Although the invention is not limited thereby, it is thought that this phenomenon is caused by some chemical reaction between the hydrocarbon in the kerogen and carbon dioxide under pyrolysis temperature conditions.

Besides the type of sweep gas, a number of other factors have been found to influence the yield of kerogen from oil shale, namely the rate of heating of the shale, the particle size of the shale and the sweep gas flow rate. The oil shale is charged to the pyrolysis chamber at approximately room temperature and, as explained above, is heated to the reaction temperature. The rate of heating can vary from 2° C. per minute to 20° C. per minute. A series of experiments were run utilizing not only different heating rates but different particle size distributions and gas flow rates. It was found that these three variables exhibit an interactive effect. The results of this interaction, as well as the contribution made by the change in sweep gas from nitrogen to carbon dioxide, can be seen in the table.

EXAMPLES 1-16

A total of 16 experiments were performed in which one or more process conditions were varied as compared to the Fischer Assay which outlines the procedure for extracting kerogen from oil shale. This assay can be found in *Colorado School of Mines Quarterly,* Vol. 69 p. 205 (1974) by Goodfellow and Atwood, and is hereby incorporated by reference. All work was performed using the apparatus shown in the FIGURE.

The table illustrates that the best oil yields (greater than 100 milliliters/kg) were obtained using carbon dioxide as the carrier gas. Runs 5 and 8 gave the best results wherein either a slow heating rate (10° C./min) and small particle size (−20+40 mesh) or a high heating rate (18° C./min) and a large particle size (−4+8 mesh) were used. It can also be seen that a low gas flow rate of 2 $cm^3$(STP)/sec gave a significant improvement in yield.

In general, the heating rate should desirably be from about 5°-20° C. per minute with from about 10°-18° C. preferred. In all of the experiments, the final reaction temperature was held between about 600° and 610° C. The particle size of oil shale should be desirably from about −20+40 mesh to about 10 centimeters in diameter, desirably from about −20+40 mesh to about 5 centimeters in diameter, and preferably between −20+40 mesh to −4+8 mesh. The gas flow rate at standard temperature and pressure is desirably from about 0.5 cc/sec to 10 cc/sec/100 cc of reactor volume with from about 2 cc/sec to 5 cc/sec/100 cc of reactor volume preferred. As is evident from the table, only the preferred ranges of process conditions were varied in obtaining data.

According to the present invention, it has been found that the oil produced or recovered from the retorting process utilizing Colorado Shale Oil has a mid-distillate of about 40 percent. That is, in accordance with ASTM Test No. D-2887, approximately 40 percent of the oil recovered has a boiling point range of from about 350° to about 700° F.

TABLE

| RUN NO. | HEATING RATE (°C./min) | PARTICLE SIZE[1] (mesh) | GAS | GAS FLOW RATE[2] (cc/sec) | OIL YIELD (ml/kilogram) |
|---|---|---|---|---|---|
| 1 | 10 | −20 + 40 | $N_2$ | 2 | 94.24 |
| 2 | 18 | −20 + 40 | $N_2$ | 2 | 92.67 |
| 3 | 10 | −4 + 8 | $N_2$ | 2 | 95.82 |
| 4 | 18 | −4 + 8 | $N_2$ | 2 | 97.38 |
| 5 | 10 | −20 + 40 | $CO_2$ | 2 | 105.87 |
| 6 | 18 | −20 + 40 | $CO_2$ | 2 | 102.09 |
| 7 | 10 | −4 + 8 | $CO_2$ | 2 | 98.01 |
| 8 | 18 | −4 + 8 | $CO_2$ | 2 | 105.24 |
| 9 | 10 | −20 + 40 | $N_2$ | 5 | 81.05 |
| 10 | 18 | −20 + 40 | $N_2$ | 5 | 84.19 |
| 11 | 10 | −4 + 8 | $N_2$ | 5 | 83.25 |
| 12 | 18 | −4 + 8 | $N_2$ | 5 | 92.67 |
| 13 | 10 | −20 + 40 | $CO_2$ | 5 | 89.53 |
| 14 | 18 | −20 + 40 | $CO_2$ | 5 | 78.54 |
| 15 | 10 | −4 + 8 | $CO_2$ | 5 | 95.81 |
| 16 | 18 | −4 + 8 | $CO_2$ | 5 | 97.38 |

[1]Normal distribution
[2]At standard temperature and pressure

While the best mode and preferred embodiments have been disclosed, it is to be understood that the invention is not limited thereto or thereby. Therefore, for a fuller understanding of the true scope of the invention, reference should be made to the following attached claims.

What is claimed is:

1. A process for pyrolysis of oil shale comprising:

crushing a quantity of Western United States type oil shale to a particle size from about −20+40 mesh to 10 cm. in diameter;

heating said shale at a rate from about 2° C./min to 20° C./min until a final temperature of between 400° C. to 700° C. is achieved, maintaining said shale at said final temperature and causing a pyrolysis reaction in said shale thereby at a pressure of from about 0.5 to about 1.5 atmospheres;

releasing gaseous and liquid product from said shale by means of said pyrolysis reaction;

conveying said product from said shale by means of a stream consisting essentially of heated carbon dioxide gas, at a temperature from 400° to 700° C., passed through said shale at a rate from about 0.5 cc/sec/100 cc of reactor volume at standard temperature and pressure to about 10 cc/sec/100 cc of reactor volume at standard temperature and pressure and cooling said product and thereby liquefying the condensable portions thereof.

2. A process according to claim 1, wherein said process is ex situ and said oil shale is selected from the group consisting of Iocene shales.

3. A process according to claim 2, wherein said heating rate is from about 10°-18° C./min. and said final temperature is between 450° and 650° C., said pressure is from about 0.8 to about 1.2 atmospheres; and wherein said particle size is from about −20+40 mesh to −4+8 mesh.

4. A process according to claim 3, wherein said carbon dioxide gas flow rate is from about 2 to about 5 cubic centimeters/second/100 cc of reactor volume at standard temperature and pressure, and wherein said final temperature is from 475° C. to 600° C., and wherein said pressure is about 1 atmosphere.

5. A process according to claim 4, wherein the heating rate is about 10° C./min, said particle size is about −20+40 mesh and said gas flow rate is about 2 cubic centimeters/second/100 cc of reactor volume at standard temperature and pressure, and wherein said oil yield is about 105 milliliters per kg of unprocessed oil shale.

6. A process according to claim 4, wherein said heating rate is about 18 degrees C./min, said particle size is about −4+8 mesh and said gas flow rate is about 2 cubic centimeters/second/100 cc of reactor volume; and wherein said oil yield is about 105 milliliters per kg of unprocessed kerogen.

7. A process according to claim 3, including recycling said carbon dioxide stream to said shale pyrolysis step.

8. A process according to claim 5, including recycling said carbon dioxide stream to said shale pyrolysis step.

9. A process according to claim 6, including recycling said carbon dioxide stream to said shale pyrolysis step.

* * * * *